US006421837B1

(12) United States Patent
Pearcy

(10) Patent No.: US 6,421,837 B1
(45) Date of Patent: Jul. 23, 2002

(54) HEADBAND

(76) Inventor: Melinda Pearcy, 1224 Arno, Kansas City, MO (US) 64113

( * ) Notice: Subject to any disclaimer, the term of this patent is extended or adjusted under 35 U.S.C. 154(b) by 0 days.

(21) Appl. No.: 09/682,475

(22) Filed: Sep. 6, 2001

(51) Int. Cl.[7] ..... A42B 1/00
(52) U.S. Cl. ..... 2/171; 132/273
(58) Field of Search ..... 2/171, 183, 174, 2/202, 203, 195.2, 208, 209, DIG. 11; 128/864, 866; 132/273, 275

(56) References Cited

U.S. PATENT DOCUMENTS 4,551,584 A * 11/1985 Mathiasen ..... 2/209
5,438,626 A * 8/1995 Neuman et al. ..... 381/183
5,449,008 A * 9/1995 Yeh ..... 132/273
5,937,872 A * 8/1999 Wang ..... 132/273
6,123,168 A * 9/2000 Berg et al. ..... 181/129

* cited by examiner

*Primary Examiner*—Gloria M. Hale
*Assistant Examiner*—Tejash Patel
(74) *Attorney, Agent, or Firm*—Spencer Fane Britt & Browne LLP

(57) ABSTRACT

A headband is provided for holding a wearer's hair in a desired position. The headband includes a top portion and two opposing side portions extending in a generally orthogonal direction from the top portion. The orthogonal shape of the headband increases the volume between the wearer's head and the headband. The increased volume provides an aesthetically pleasing, non-compressed and natural appearance for curly, thick or full-bodied hair.

3 Claims, 1 Drawing Sheet

HEADBAND

FIELD OF THE INVENTION

The present invention relates to a headband to be worn in hair primarily to hold a wearer's hair in a desired position for the purpose of convenience or decoration.

BACKGROUND OF THE INVENTION

The use of a headband to hold a wearer's hair in a desired position is well known. Headbands can be used to position hair for a variety of reasons including convenience and aesthetics. Many people that have longer hair will wear a headband for the purpose of holding their hair back out of their face while at the same time providing an aesthetically pleasing appearance. While the headbands of the prior art are effective in holding back a person's hair, they tend to conform closely to the wearer's head resulting in a tight compression of the hair. This results in a less than desirable appearance when a person having curly, thick or full-bodied wears the headband. Therefore, it is desirable to provide a headband that will hold a wearer's hair in a desired position, while simultaneously providing curly, thick or full-bodied hair to be positioned in a more natural, non-compressed, manner.

SUMMARY OF THE INVENTION

A primary object of the present invention is to provide a headband that will hold a wearer's hair in a desired position. A further object of the present invention is to provide a headband that will hold curly, thick or full-bodied hair in a desired position without compressing the hair in an unnatural manner.

In order to overcome the problems with the prior art and achieve the above described objects, the instant invention provides a headband having a top portion and two side portions extending downward from the top portion in a direction generally orthogonal to the top portion.

The orthogonal relationship between the top and side portions of the instant invention provides spacing between the upper side portions of the wearer's head and the headband.

This allows the wearer's hair to occupy a larger volume, which is more natural and aesthetically pleasing for curly, thick or full-bodied hair.

The headband of the instant invention can be constructed as an integral unit; or alternatively, the top and two side portions can be separate members, which can be connected together using a hinge. The hinged connection allows the headband to be folded together for easy storage in a manner similar to that of eyeglasses.

The foregoing and other objects are intended to be illustrative of the invention and are not meant in a limiting sense. Many possible embodiments of the invention may be made and will be readily evident upon a study of the following specification and accompanying drawings comprising a part thereof. Various features and sub combinations of invention may be employed without reference to other features and sub combinations. Other objects and advantages of this invention will become apparent from the following description taken in connection with the accompanying drawings, wherein is set forth by way of illustration and example, an embodiment of this invention.

DESCRIPTION OF THE DRAWINGS

Preferred embodiments of the invention, illustrative of the best modes in which the applicant has contemplated applying the principles, are set forth in the following description and are shown in the drawings and are particularly and distinctly pointed out and set forth in the appended claims.

Description of the Preferred Embodiment

Preferred embodiments of the present invention are hereinafter described with reference to the accompanying drawings.

Figure 1:
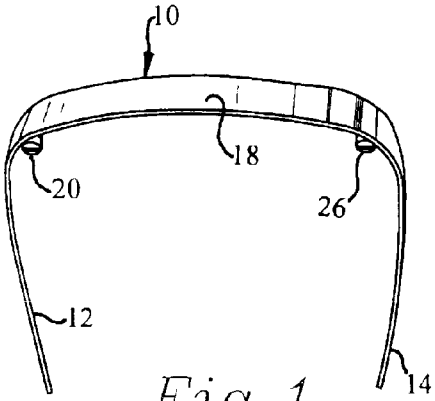
FIG. 1 is a frontal perspective view of the headband of the instant invention.

Referring to FIG. 1, a preferred embodiment of the headband of the instant invention is shown. Headband 10 includes top portion 18 and side portions 12 and 14. First side portion 12 extends in a generally orthogonal direction from a first end of top portion 18, and second side portion 14 extends in a generally orthogonal direction from the opposing end of top portion 18.

In a preferred embodiment, first side portion 12 is pivotally connected to the first end of top portion 18 via hinge 20, and second side portion 14 is pivotally connected to the second end of top portion 18 via hinge 26. When hinges 20 and 26 are in a fully open position, side portion 12 and 14 extend in a generally orthogonal direction from top portion 18. Hinges 20 and 26 can be closed making side portions 12 and 14 generally parallel to top portion 18. The hinges allow for the easy storage of headband 10 when it is in a folded, or closed, position.

Figure 2:
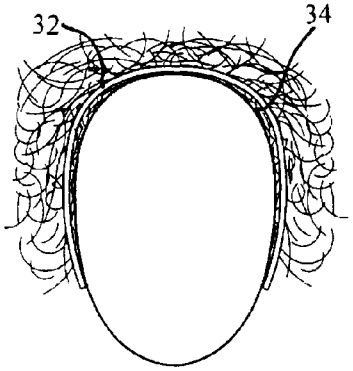
Fig. 2. (Prior Art)
FIG. 2 is a front sectional view of a prior art headband positioned on a wearer's head.
Figure 3:
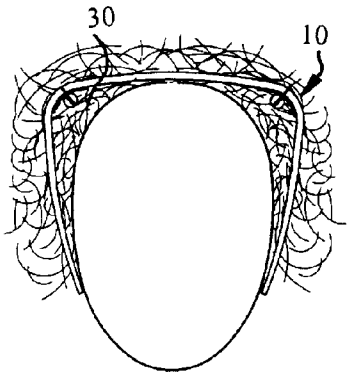
FIG. 3 is a front sectional view of the headband of the instant invention positioned on a wearer's head.

The benefits of the headband of the instant invention over that of the prior art are shown through a comparison of FIGS. 2 and 3. FIG. 2 shows prior art headband 32 positioned on a wearer's head. As is apparent in FIG. 2, headband 32 conforms closely to the contour of the wearer's head, leaving virtually no space in area 34 between the wearer's head and headband 32. Thus, the hair of a person having curly, thick or full-bodied hair will be compressed by headband 32 into an unnatural position. This provides an appearance that is undesirable to many wearers.

In contrast, FIG. 3 shows the headband of the instant invention positioned on a wearer's head in the same manner as headband 32 of FIG. 2. As is readily apparent in FIG. 3, the orthogonal design of headband 10 results in a rather large space in area 30 between the wearer's head and the headband compared to that in area 34 of the prior art headband. This space, or volume, allows headband 10 to hold the wearer's hair in position without substantial compression. Curly, thick or full-bodied hair can occupy more space, thus resulting in a more natural and aesthetically pleasing appearance.

Figure 4:
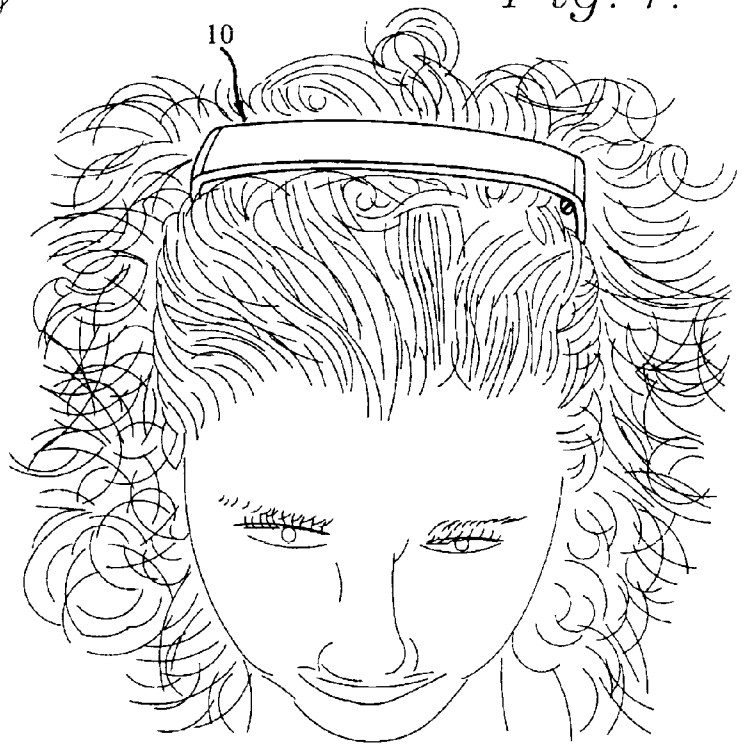
FIG. 4 is a frontal perspective view of the headband of the instant invention positioned on a wearer's head.

A frontal perspective view of headband 10 on a wearer's head is shown in FIG. 4 which illustrates the natural, uncompressed appearance of a wearer's hair when using headband 10.

Although the preferred embodiment of headband 10 is foldable or collapsible, the instant invention can include a fixed or generally rigid design.

Headband 10 can be constructed of virtually any material that provides adequate rigidity to hold the wearer's hair in position and maintain the orthogonal shape of the headband. A plastic material is preferred due to its lighter weight. Additionally, a slightly flexible material can be utilized to allow for variations in the size and shape of the wearer's head. Hinges 20 and 26 can be constructed of any suitable material including plastic or metal. Additionally, headband 10 can be constructed as a single component including a living hinge.

Figure 5:
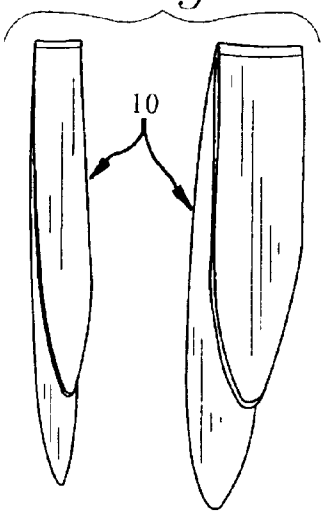
FIG. 5 is a side view of several embodiments of the headband of the instant invention.

Headband 10 can be provided in a variety of colors and including a virtually unlimited range of ornamentation. Headband 10 can be of a solid color, or multiple colors can be used. Logos can be printed on the headband, or other objects can be attached to the headband to increase its overall aesthetic appearance. As shown in FIG. 5, headband 10 can be constructed of virtually any size, so long as the orthogonal relationship between the side portions and the top portion is maintained.

In the foregoing description, certain terms have been used for brevity, clearness and understanding; but no unnecessary limitations are to be implied therefrom beyond the requirements of the prior art, because such terms are used for descriptive purposes and are intended to be broadly construed. Moreover, the description and illustration of the inventions is by way of example, and the scope of the inventions is not limited to the exact details shown or described.

Certain changes may be made in embodying the above invention, and in the construction thereof, without departing from the spirit and scope of the invention. It is intended that all matter-contained in the above description and shown in the accompanying drawings shall be interpreted as illustrative and not meant in a limiting sense.

Having now described the features, discoveries and principles of the invention, the manner in which the inventive headband is constructed and used, the characteristics of the construction, and advantageous, new and useful results obtained; the new and useful structures, devices, elements, arrangements, parts and combinations, are set forth in the appended claims.

It is also to be understood that the following claims are intended to cover all of the generic and specific features of the invention herein described, and all statements of the scope of the invention which, as a matter of language, might be said to fall therebetween.

Having thus described the invention what is claimed as new and desired to be secured by Letters Patent is as follows.

What is claimed is:

1. A headband comprising:

a top portion having a first end and a second end opposed to said first end, said top portion including a planar surface associated with the wearer's head;

a first side portion extending in a direction generally orthogonal to said first end, said first side portion including a planar surface associated with the wearer's head; and a second portion extending is a direction generally orthogonal to said second end, said second portion including a planar surface associated with the wearer's head.

2.The headband as claimed in claim 1 further comprising a pivotal connection between said top portion and at least one of said first side portion or said second side portion.

3.The headband as claimed in claim 2 wherein said pivotal connection comprises a hinge.

* * * * *